US010314126B2

(12) United States Patent
Kohlgrüber et al.

(10) Patent No.: US 10,314,126 B2
(45) Date of Patent: Jun. 4, 2019

(54) CHIP FOR USE IN AN OPERATING DEVICE FOR LIGHTING MEANS AND OPERATING DEVICE COMPRISING SUCH A CHIP

(71) Applicant: TRIDONIC GMBH & CO KG, Dornbirn (AT)

(72) Inventors: Stefan Kohlgrüber, Feldkirch (AT); Florian Moosmann, Muntlix (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 66 days.

(21) Appl. No.: 15/538,731

(22) PCT Filed: Feb. 26, 2016

(86) PCT No.: PCT/AT2016/050044

§ 371 (c)(1),
(2) Date: Jun. 22, 2017

(87) PCT Pub. No.: WO2016/134399

PCT Pub. Date: Sep. 1, 2016

(65) Prior Publication Data

US 2018/0139814 A1 May 17, 2018

(30) Foreign Application Priority Data

Feb. 26, 2015 (DE) ..... 20 2015 100 929 U
Jun. 1, 2015 (AT) ..... GM136/2015

(51) Int. Cl.
*H05B 33/08* (2006.01)

(52) U.S. Cl.
CPC ..... *H05B 33/0842* (2013.01); *H05B 33/0815* (2013.01)

(58) Field of Classification Search
CPC ..... H05B 33/0815; H05B 33/0842
See application file for complete search history.

(56) References Cited

U.S. PATENT DOCUMENTS 6,417,695 B1 7/2002 Duesman
6,856,519 B2 2/2005 Lin et al.
2003/0206426 A1* 11/2003 Lin ..... H02M 7/53806 363/132

(Continued)

FOREIGN PATENT DOCUMENTS

EP 2 760 116 7/2014
EP 2 779 400 9/2014

OTHER PUBLICATIONS

Austria search report dated Sep. 26, 2018 in co-pending Austria patent application GM 136/2015.

(Continued)

*Primary Examiner* — Douglas W Owens
*Assistant Examiner* — Pedro C Fernandez
(74) *Attorney, Agent, or Firm* — Andrus Intellectual Property Law

(57) ABSTRACT

The invention relates to a chip (1) for use in an operating device for lighting means, wherein the chip (1) is designed to control a processing block (2) of an operating device for lighting means, wherein the chip (1) can control a plurality of different processing blocks (2) which differ in their function, wherein the chip (1) is designed to select on the basis of at least one signal applied to the chip (1) what type of processing block (2) should be controlled.

21 Claims, 2 Drawing Sheets

(56) References Cited

U.S. PATENT DOCUMENTS

| | | | | |
|---|---|---|---|---|
| 2005/0017940 | A1 | 1/2005 | Shunpei et al. | |
| 2011/0032024 | A1 | 2/2011 | Chen et al. | |
| 2012/0206064 | A1 | 8/2012 | Archenhold | |
| 2014/0210377 | A1 * | 7/2014 | Knoedgen ..... | H02M 3/33507 315/307 |

OTHER PUBLICATIONS

German search report in priority German application 20 2015 100 929.1 dated Sep. 11, 2015.
PCT search report in parent PCT application PCT/AT2016/050044 dated Sep. 1, 2016.
Fisher, P., PALs, CPLDs und FPGAs, Uni Mannheim, 2003 (in the German language).

* cited by examiner

CHIP FOR USE IN AN OPERATING DEVICE FOR LIGHTING MEANS AND OPERATING DEVICE COMPRISING SUCH A CHIP

CROSS REFERENCE TO RELATED APPLICATION

The present application is the U.S. national stage application of International Application PCT/AT2016/050044, filed Feb. 26, 2016, which international application was published on Sep. 1, 2016 as International Publication WO 2016/134399 A2. The International Application claims priority to German Patent Application 20 2015 100 929.1 filed Feb. 26, 2015 and Austria Patent Application GM 136-2015 filed Jun. 1, 2015.

FIELD OF THE INVENTION

The present invention relates to a chip for use in an operating device for lighting means, wherein the chip is designed to control a processing block of the operating device. The invention also relates to an operating device, particularly for LEDs, comprising such a chip.

BACKGROUND OF THE INVENTION

Depending on the area of operation or the design of the lighting assembly, operating devices or converters are frequently provided in lighting assemblies to which respective lighting means of the lighting assemblies are connected. The lighting means can be light-emitting diodes (LEDs), for example, which are used more and more frequently as lighting means in various fields of lighting systems. LEDs have considerable advantages especially in terms of durability and energy efficiency compared with conventional lighting means, while also providing sufficient lighting intensity.

Corresponding operating devices are also used in lighting assemblies with other lighting means, wherein, regardless of the type of the lighting means, the operating device is designed and intended to supply the lighting means with a respective suitable current and to also control the lighting means accordingly.

Operating devices for LEDs as well as other lighting means often have different processing blocks that are connected with each other accordingly within an operating device. These processing blocks can be a Power Factor Correction block (PFC block), a buck converter, a step up converter or boost converter block, an insulated fly back converter block or a half-bridge block, preferably a resonant and/or insulated half-bridge block (HB/LLC block). The precise structure of such processing blocks as well as the use and interconnection within an operating device are already widely known, which is why they need not be further elaborated on here.

It should now be noted that such processing blocks are to be normally controlled, regardless of their function or type, by detecting or measuring a voltage within the processing block, for example, which is transmitted to a chip that can then control the respective processing block according to the voltage. Controllable switches or gates can be provided in the processing block for that purpose, which make it possible for the chip to control or regulate the processing block accordingly. Instead of controllable switches or gates, it is also known to control the processing block through the chip by other means.

As shown in FIG. 1 by way of example, several processing blocks 2 are provided in an operating device, wherein a chip 1 is assigned to each processing block 2 to control the respective processing block 2. It should be noted that processing blocks of different types are included in the operating device. As each processing block 2 requires a different actuation or control through the chip depending on its function, it is necessary that a distinct chip with a distinct inside structure or distinct connection must be provided for each type of processing block.

Chips or ICs that are primarily used today merely support a specific topology, i.e. a specific type of processing block. Accordingly, it is necessary, when using processing blocks of different types or with different functions, that a new chip be developed for each type of processing block, requiring considerable effort both during manufacturing and during the respective tests for the function and the like. It also requires more logistical effort because different types of chips must be kept available and in distribution.

SUMMARY OF THE INVENTION

According to the present invention, a chip is provided in an operating device for lighting means, wherein the chip is designed to control a processing block of the operating device. The chip can control a plurality of different processing blocks which differ in their function wherein the chip is configured to select what type of processing block should be controlled on the basis a signal applied to the chip.

This configuration makes it possible for the chip to easily determine what type of processing block it should control on the basis of a signal applied to the chip.

The control of the processing block preferably takes place as a function of an input signal applied to the chip, wherein the chip is designed to output control signals for controlling the processing block.

The selection of which type of processing block should be controlled can take place on the basis of the input signal, wherein the input signal includes various parameters and the selection can take place as a function of at least one parameter. These parameters, for instance, can be the curve form and/or the frequency and/or the amplitude and/or the duty cycles and/or the threshold values and/or timings, such as a time value specification, and/or maximum values of the input signal.

As an alternative to the input signal, a selection signal applied to the chip can also be used to choose which type of processing block shall be controlled. In other words, the selection takes place depending on a selection signal applied to the chip. The selection signal can have different parameters and the selection can take place depending on at least one parameter. Advantageously, this is the voltage level of the selection signal.

The chip preferably also has several pins for the output and receipt of signals.

A control unit may furthermore be provided in the chip such that it can control the chip for each processing block of the plurality of processing blocks having different functions.

The chip is preferably designed such that each control unit of the chip can be connected with each pin of the chip.

Controllable switches or gates may also be provided in the chip between the control units and the pin, and the chip can be designed such that the controllable switches or gates are controlled by the signal applied to the chip for selecting what type of processing block should be controlled.

Additional comparators are advantageously provided in the chip, which can control the controllable switches or gates depending on the signal applied to the chip to choose what type of processing block should be controlled.

The controllable switches or gates can be transistors, particularly FET transistors. The controllable switches or gates can be one or several multiplexers.

One embodiment of the invention is provided by a chip, particularly ASIC, which can support all different topologies (processing blocks) used in the operating device. With this technology, the selection is made by means of an OTP programming or an OTP file (OTP stands for "one-time programmable" therefore a one-time programmable memory data set), that selects, via a sector block, the topology, and therefore which type of processing block, that shall be supported. In other words, the type of processing block the chip can control is determined by means of this OTP file.

The chip can have a pin designed to be used for the reception of a selection signal only during a programming mode, preferably during the production of the operating device, and which is used in normal operation to receive and/or output other signals.

Provision is furthermore made for an operating device for lighting means having at least one processing block and at least one chip dedicated to the processing block. The operating device preferably has several processing blocks that each have a different function, where a chip is dedicated to each processing block.

The processing blocks and/or the processing blocks of the operating device may be, for example, a PFC (Power Factor Correction block), HB (half-bridge)/LLC block, a buck converter block, a boost Converter block (step up converter), or a fly back converter (insulated fly back converter) block. Additionally or alternatively, the processing blocks of the operating device can be an SEPIC converter block, buck/boost converter block, forward-converter block, two-switch forward-converter block, active clamp forward converter block, push pull converter block, full bridge block, or a phase shift ZVT converter block.

Different stages of the same type may also be used, e.g. 3 buck-converter blocks, that perform different functions.

Advantageously, the processing block or the processing blocks have switches or gates that are controlled by the chip or the chips.

The design of the chip according to the invention offers the advantage that, for different types of processing blocks, only one chip is required to control the respective processing block, as the chip itself can determine internally, which topology it supports on the basis of the applied signal, i.e., which processing block it can control. Different kinds or types of chips are therefore also not necessary for several types of processing blocks, resulting in a series of tests for different kinds or types of chips also being eliminated. Furthermore, a plurality of different OTP files is not necessary either.

Moreover, the chip can also be easily converted, subsequently or during operation, to support a different topology.

BRIEF DESCRIPTION OF THE DRAWINGS

The invention shall be explained below on the basis of exemplary embodiments and the attached drawings. Therein.

DETAILED DESCRIPTION

Figure 1:
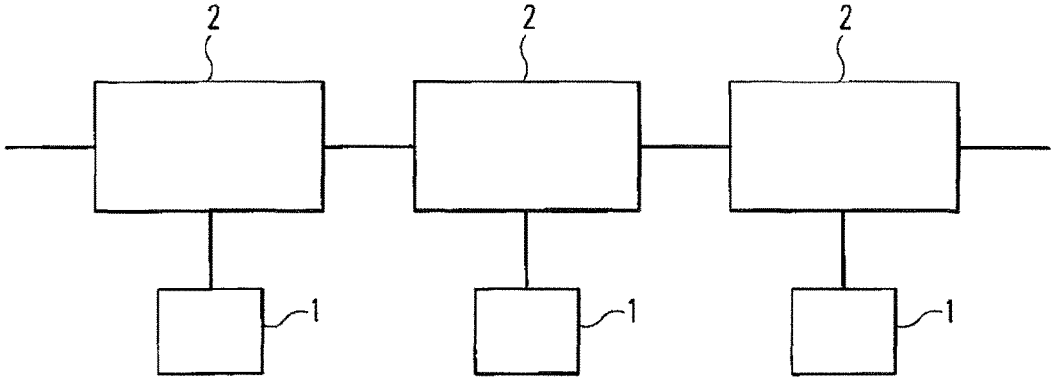
FIG. 1 shows a diagram of an operating device with several processing blocks and several chips.

As stated above, several processing blocks 2 of an operating device for lighting means are shown in FIG. 1, where a chip 1 is dedicated to each processing block 2 that controls the respective processing block 2.

It must be noted that the connection between the chips 1 and the processing blocks 2 and between the processing blocks 2 among one another is merely shown schematically in FIG. 1. The precise interconnection of the processing blocks 2 among one another and with the chips 1 can thus not be derived from FIG. 1. That is however well-known, which is why it is not discussed here any further.

As explained previously, it is provided that the processing blocks 2 are controlled by the chips 1 in an operating device for lighting means. Specific parameters of the processing block 2, such as a specific voltage, can be transmitted to the associated chip for this purpose. By means of these parameters originating from the respective processing block 2, which are applied to the chip 1 as an input signal, the chip 1 can control the processing block 2 accordingly. This takes place, for example, by providing the processing block 2 with respective controllable switches or gates enabling the control or regulation of the processing block 2. The control of the processing blocks 2 through the chips can, however, also take place in a different manner.

To control the processing blocks 2 through the chips 1, the chips 1 can be designed to send a control signal to the processing blocks 2.

As explained above, a different chip 1 has previously been required for each type of processing block 2 in order to control the respective processing block. The type of processing block 2 or the function that a processing block 2 fulfills may include a PFC block, a buck converter block, an HB/LLC block, or a fly back converter block, for example, which are also well-known.

In order to enable the use of just one chip 1 with different types of processing blocks 2 and to simplify and achieve cost-savings, according to the present invention, the chip 1 can control a plurality of different processing blocks 2 which differ in their function, wherein the chip 1 is designed to select the type of processing block 2 that should be controlled on the basis of at least one signal applied to the chip 1.

Figure 2:
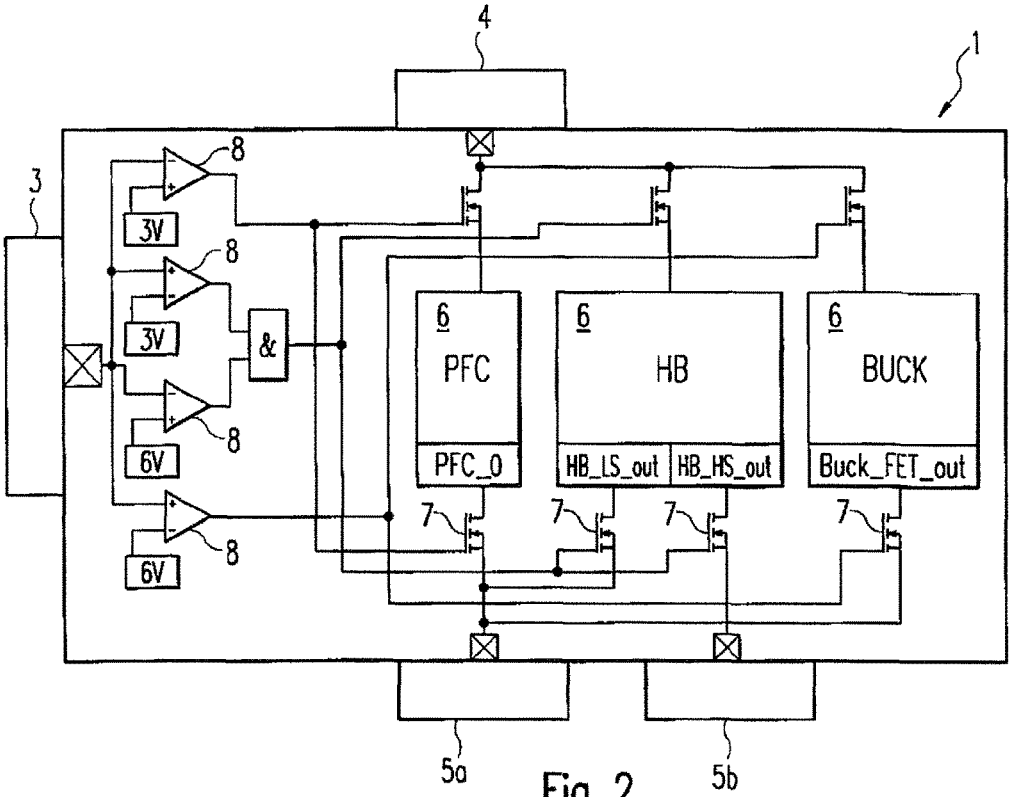
FIG. 2 shows a diagram of the internal structure of a chip according to the invention.
Figure 3:
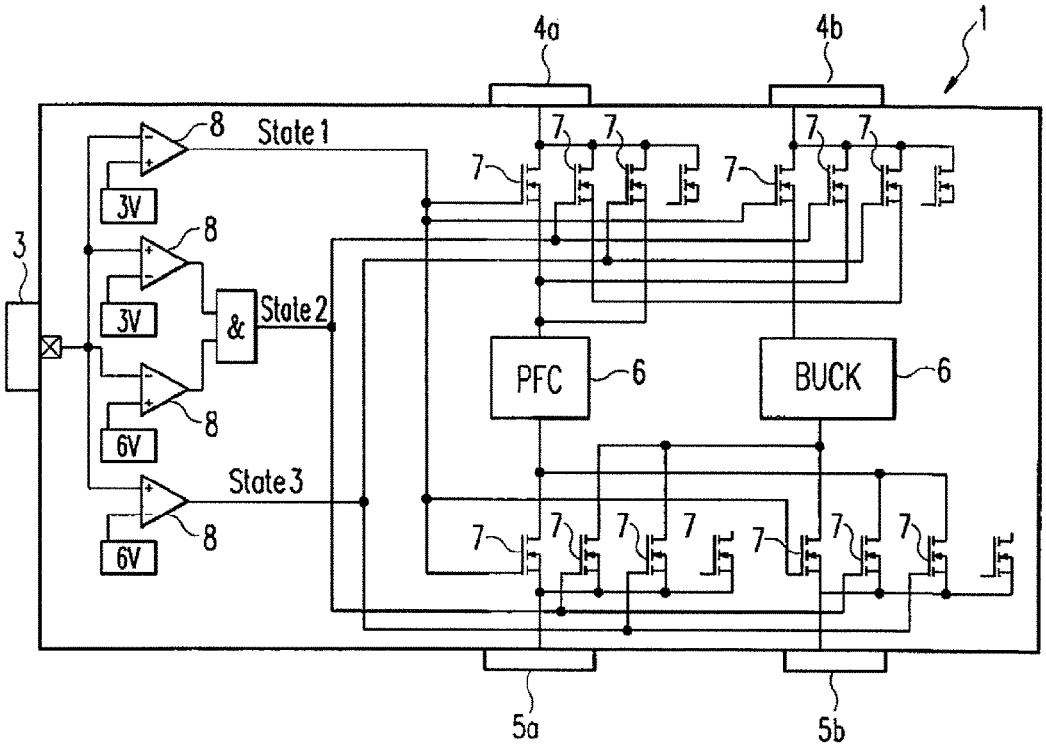
FIG. 3 shows a diagram of the internal structure of a chip according to the invention.

This signal, applied to the chip 1 for selecting the type of processing block, can be an additional selection signal or topology selection signal, which is applied to an additional pin of the chip 1. Such chips 1, with which a special selection signal is applied to the chip 1, are shown in FIGS. 2 and 3. The selection signal can have different parameters and the selection depends on at least one parameter. The voltage level of the selection signal, in particular, is provided as a selection criterion.

Alternatively to a selection signal, the selection of which type of processing block 2 should be controlled can also be a function of an input signal. The input signal has different parameters, wherein the selection takes place as a function of at least one parameter. These parameters, for instance, can be the curve form, the frequency, the amplitude, the duty cycles, the threshold values, the timings, and the maximum values of the input signal. In other words, in the event that the chip 1 performs the selection with regard to which type of processing block 2 should be controlled by means of the input signal, the chip 1 can recognize, autonomously and independently, on the basis of the parameter of the input signal, which topology it is supposed to support, i.e. which type of processing block 2 it is supposed to control. In view of the parameters of the input signal, it should be noted that this involves specific fingerprints in the input signal or specific characteristics of the input signal.

It should also be noted that the input signals of the different types of processing block 2 must each differ in at least one parameter, such that the chip 1 is able to recognize a respective difference and, based on this, is able to determine which topology is supposed to be supported.

As previously explained, FIGS. 2 and 3 each show a schematic diagram of the structure of a chip 1, in which an additional selection signal is provided, in order to select what type of processing block 2 should be controlled. This selection signal is applied to a pin 3 of the chip 1, the pin 3 being an additional, or extra, pin.

In FIG. 2, the chip 1 comprises a pin 4 to which an input signal is applied in accordance with the input signal described above, which can also be described as a sensing signal. As already mentioned above, this is a signal that can originate from the processing block 2, such as a specific voltage value of the processing block 2 by means of which the chip 1 controls the respective processing block 2.

Two pins 5*a* and 5*b* are also provided, at which respective control signals are output from the chip 1, by means of which the processing blocks 2 can be controlled.

Internally, the chip 1 has three control units 6 in FIG. 2, wherein each control unit 6 has controls for a different type of a processing block 2, and comprises control means or control components for controlling the respective type of a processing block 2, which are not shown in detail in FIG. 2 as these are widely known. For example, the control unit 6 for controlling a PFC block can have control components that are comparable or identical to those of a conventional, previously used, chip for controlling a PFC block.

Due to the three control units 6, the chip 1 shown in FIG. 2 is able to control three different types of processing blocks 2. As is clear from FIG. 2, the control units 6 are control units for a PFC block, an HB/LLC block or HB block, and a buck converter block.

Respective controllable switches or gates in the form of FET transistors 7 are provided both between the pin 4 to which the input signal is applied and the control units 6, as well as between the control units 6 and the pins 5*a* and 5*b*, at which respective control signals are output. Instead of the FET transistors 7, other types of transistors or any other form of switches or controllable elements can be used as controllable switches or gates, e.g., the gates may also be designed as multiplexers.

By means of these FET transistors 7, it is possible, on the one hand that the input signal applied to the pin 4 is selectively applied to one of the control units 6 through the FET transistors 7, which are disposed between the pin 4 and the control units 6. On the other hand, there is the possibility that a control signal output by the control unit 6 is applied to the pins 5*a* and 5*b* through the FET transistors 7 that are disposed between the control units 6 and the pins 5*a* and 5*b*.

In this regard, it should be noted that in FIG. 2, the control unit 6 for the PFC block and the control unit 6 for the buck converter block can each selectively apply a control signal (PFC_out or Buck_FET_out) to the pin 5*a*, and that the control signal 6 outputs two control signals (HB_LS out and HB_HS_out) for the HB/LLC or HB block, wherein one of the two control signals is fed to the pin 5*a* and the other control signal is fed to the pin 5*b*.

Due to the configuration of the FET transistors 7 disosed between the control units 6 and the pins 4 and 5, it is thus possible that the selected one of the control units 6 is fed both the input signal applied to the pin 4 and sends the control signals output by the respective control unit 6 to the pin or pins 5, so that the control signal or the control signals are output accordingly and can be forwarded to the respective processing block.

The selection of which control unit 6 is supposed to be used takes place by means of the selection signal applied to the additional pin 3. This means that the selection of the control unit 6 corresponds to the selection of which type of processing block 2 the chip 1 can or should control.

The evaluation of the selection signal applied to the pin 3 takes place by means of comparators 8 to which the selection signal is applied, wherein these comparators 8 control the FET transistors as a function of the voltage level of the selection signal.

The comparators shown in FIG. 2 and FIG. 3 are merely shown by way of example, in order to facilitate understanding. It is also possible to carry out the evaluation differently than on the basis of voltage level, e.g., by means of the frequency of the signal (e.g. through a counter _>f>20 kHz=topology 1, f<20 kHz=topology 2), duty cycle, AC/DC . . . .

Specifically, in the embodiment shown in FIG. 2, the selection signal essentially assumes three states: a first state 1 describing a voltage level of less than 3 volts; a second state 2 describing a voltage level of between 3 and 6 volts; and a third state 3 describing a voltage level of more than 6 volts. If the voltage level of the selection signal is less than 3 volts, the control unit 6 for the PFC block is selected, if the voltage level is between 3 and 6 volts, the control unit 6 for the HB block is selected, and if the voltage level is more than 6 volts, the control unit 6 for the buck converter block is selected.

A first comparator 8 is provided for the assessment of the voltage level of less than 3 volts, which is connected with the FET transistors 7 that make it possible for the input signal applied to the pin 4 to be forwarded to the control unit 6 for the PFC block, and that the control signal output by the PFC block is fed to the pin 5*a*. A second and third comparator 8 are provided for the voltage range between 3 volts and 6 volts, which are connected with the FET transistors 7 through an AND gate, which make it possible for the control unit 6 for the HB block to receive the input signal and for the respective output or control signals to be forwarded to the pins 5. For the voltage levels of more than 6 V, a fourth comparator is provided, which is connected with the FET transistors that make it possible for the input signal to be applied to the control unit 6 for the buck converter block, and for the control signal of this control unit 6 to then be applied to the pin 5*a*.

This wiring of the comparators 8 with the AND gate and the FET transistors 7 is also shown in the following table, which lists the different voltage levels and the resulting connections for the pin 4 and the pins 5*a* and 5*b* and which signals are applied accordingly.

| V_Pin 3 | State | Pin 4 | Pin 5a | Pin 5a |
|---|---|---|---|---|
| <3 V | 1 | PFC_sensing | PFC_out | — |
| 3 V < x < 6 V | 2 | HB_sensing | HB_LS_out | HB_HS_out |
| >6 V | 3 | Buck_sensing | Buck_out | — |

With a voltage of the output signal of less than 3 volts, the result is therefore a so-called PFC controller or a chip 1 provided for controlling a PFC block. With a voltage of between 3 and 6 volts, the result is an HB controller or a chip 1, suited for controlling an HB block. And with a voltage of more than 6 volts, the result is a buck converter controller, or a chip 1 that is suited for controlling a buck converter block.

Another chip 1 shown schematically in FIG. 3, in which the selection of which type of processing block 2 should be controlled again takes place based on a selection signal applied to the chip 1, and in particular applied to an additional pin 3. Similar to FIG. 2, two pins 5*a* and 5*b* are also provided on the chip 1 in FIG. 3.

In contrast to FIG. 2, merely two control units 6 are provided in the chip 1 in the embodiment in FIG. 3; a control unit 6 for a PFC block, and a control unit 6 for a buck converter block. The chip 1 in FIG. 3 furthermore has two pins 4*a* and 4*b* for respective input signals.

As in FIG. 2, controllable switches or gates are also provided in FIG. 3 in the form of FET transistors 7, wherein, as in FIG. 2, the transistors 7 are disposed between the pins 4*a* and 4*b* and the control units 6 and between the control units 6 and the pins 5*a* and 5*b*. The FET transistors 7, in turn, are additionally also controlled through respective comparators 8 by means of the selection signal applied to the pin 3.

However, it is now important to note that in FIG. 3 the control unit 6 for the PFC block can also be connected with both the pin 4*a* and the pin 4*b*, and the control unit 6 for the buck converter block can also be connected with the pin 4*a* and the pin 4*b*. This provides the possibility that an input signal can be applied to both pins 4*a* and 4*b*, and regardless of which pin, 4*a* or 4*b*, the input signal is applied to, it can be forwarded to either of the control units 6 provided in the chip 1. Similarly, this feature also applies to the control signals issued by the control units 6, such that control signals can be forwarded to both pins 5*a* and 5*b* by both control units 6.

Referring still to FIG. 3, with a voltage level of less than 3 volts, for example, the control unit 6 for the PFC block is connected with the pins 4*a* and 5*a*, and the control unit 6 for the buck converter block is connected with the pins 4*b* and 5*b*. With a voltage level of between 3 volts and 6 volts, on the other hand, the control unit 6 for the PFC block is connected with the pins 4*b* and 5*b*, and the control unit 6 for the buck converter block is connected with the pins 4*a* and 5*a*, and with a voltage level of more than 6 volts, the control unit 6 for the PFC block is connected with the pins 4*a* and 5*b* and the control unit 6 for the buck converter block is connected with the pins 4*b* and 5*a*.

This can also be derived from the following table listing the different voltage levels and the corresponding connections.

| V_Pin 3 | State | Pin 4a | Pin 4b | Pin 5a | Pin 5b |
|---|---|---|---|---|---|
| <3 V | 1 | PFC_sensing | Buck_sensing | PFC_out | Buck_out |
| 3 V < x < 6 V | 2 | Buck_sensing | PFC_sensing | Buck_out | PFC_out |
| >6 V | 3 | PFC_sensing | Buck_sensing | Buck_out | PFC_out |

An example is thus shown in FIG. 3, in which the two control units 6 can each be connected with different pins 4*a* and 4*b* to which the input signal is applied and with different pins 5*a* and 5*b* to output the respective control or output signals.

One embodiment comprises a chip 1, ASIC, in particular, which can support different processing blocks 2 that are used in the operating device. With this embodiment, the topology, and thus which kind of processing blocks 2, that should be supported is selected, through a selector block, by means of an OTP programming (a "one-time programmable" programming, therefore a one-time programming of a memory) or an OTP file. This means that the type of processing blocks 2 the chip can control is specified through this OTP programming.

By way of example, pin 3 can also be used to receive a selection signal only during a programming mode during the production of the operating device, and can then be used in normal operation to receive and output other signals such as measurement signals and/or control signals. For instance, pin 3 can be used in normal operation of the operating device, such as to control a connected lighting means to specify the nominal lighting means current or the lighting means output. When receiving a selection signal only in a programming mode, it may be provide, for example, that the topology, and thus which type of processing blocks 2, that should be supported is selected and specified by means of OTP programming.

With this exemplary embodiment, where the selection signal is only received once during a programming mode, and the selection signal is no longer queried in normal operation, it can be checked, for example, during each new start of the operating device in the chip 1, which support of processing blocks 2 was selected by the selecting signal received in programming mode. For instance, the OTP programming or the OTP file stored in chip 1 can be queried. A new start of the operating device, for instance, can be the booting up of the operating device when applying a supply voltage to the operating device.

Theoretically, is feasible, with a plurality of pins and control units, for each pin to be connected or dedicated to each control unit, in any arbitrary combination, through the use of a plurality of controllable switches or gates, e.g. multiplexers, depending on the selected state. This makes it possible to simplify the layout within an operating device and save on wire jumpers due to the beneficial layout, when, for example, it is advantageous if the input signal for the control unit for the PFC block cannot be applied to a first pin on the chip from the outside but can be applied to another pin.

Using a multiplexer in this way means that each control unit of the chip can be connected with each pin of the chip.

Due to the chip 1 according to the invention, and the special feature that what type of processing block should be controlled can be chosen by a signal applied to the chip, there is the possibility to use one and the same chip for the control of different types of processing blocks in a simple manner. This means, it is only necessary to develop and to test one single chip, thus saving considerable costs and development expenses. There is also the possibility of simplification when creating layouts for operating devices, as any desired assignment of the pins and the control units can be made within the chips.

The simple selection of a signal applied to the chip with regard to what type of processing block the chip is supposed to control, makes it possible to perform the selection only once during the production of an operating device, for example. This means that with an operating device having several processing blocks, several identical chips can be assigned to each processing block, and the selection then takes place by means of respective signals. But it would also be possible through the simple selection that the selection takes place during the operation of an operating device for lighting means, or that the selection is altered during the operation. This would also be conceivable in the case in which the chip assesses the input signal accordingly.

Pin 3 can also be used only during a programming mode during the production of the operating device to receive a selection signal, and it can be used in a normal operation to receive and/or output other signals such as measurement signals and/or control signals.

It must therefore be noted overall that both before and during the operation of the operating device, a selection can take place in a simple manner. The connecting of the chip is thus not specified beforehand but takes place on the basis of one or more signals.

What is claimed is:

1. A chip (1) for use in an operating device for lighting means, wherein the chip (1) is configured to control at least one processing block (2) in the operating device for lighting means, and wherein the chip (1) is adapted to control a plurality of different processing blocks (2) which differ in function, and the chip (1) is configured to select on the basis of at least one signal applied to the chip (1) what type of processing block (2) should be controlled;

wherein the chip (1) has several pins (4, 5) for the output and the reception of signals; a control unit (6) is provided in the chip (1) for each processing block (2) of the plurality of different processing blocks (2) differing in their function that can control the chip (1); and the chip (1) is configured such that each control unit (6) of the chip (1) can be connected with each pin (4, 5) of the chip (1).

2. The chip according to claim 1, wherein at least one processing block is selected from a performance correction filter (PFC) block, a half-bridge block, a buck converter block, a SEPIC converter block, a buck boost converter block, a forward converter block, or a fly back converter block.

3. The chip according to claim 2 wherein the chip (1) is configured to output control signals to control the processing block; and the control of the processing block (2) is based on an input signal applied to the chip (1).

4. The chip according to claim 3 wherein the selection of what type of processing block (2) should be controlled is based on the input signal; and the input signal has different parameters and the selection is based on at least one parameter chosen from the curve form, the frequency, the amplitude, the duty cycles, the threshold values, timings and max values of the input signal.

5. The chip according to claim 1 wherein the selection of which type of processing block (2) should be controlled is based on a selection signal applied to the chip (1); and the selection is based on the voltage level of the selection signal.

6. The chip according to claim 1, wherein controllable switches and/or gates (7) are disposed between the control units (6) and the pins (4, 5) in the chip (1); the chip (1) is configured such that the controllable switches and/or gates (7) are controlled by the signal applied to the chip (1) to select what type of processing block (2) should be controlled; and comparators (8) are included in the chip (1), which can control the controllable switches and/or gates (7) depending on the signal applied to the chip (1) to select what type of processing block (2) should be controlled.

7. The chip according to claim 6, wherein the controllable switches and/or gates comprise FET transistors (7).

8. The chip according to claim 6, wherein the controllable switches and/or gates comprise one or several multiplexers.

9. The chip according to claim 1, wherein the chip has a pin (3), and the pin (3) is used in a programming mode during the production of the operating device for the receipt of a selection signal and is used in normal operation to receive and/or output other signals.

10. An operating device for LED lighting means wherein the operating device is provided with at least one processing block (2) and at least one chip (1) assigned to the processing block (2) in accordance with claim 1.

11. The operating device for lighting means according to claim 10, wherein the operating device has several processing blocks (2) that comprise a different function each, wherein a chip (1) is assigned to each processing block; the processing blocks (2) of the operating device comprise a performance factor correction filter (PFC) block, half-bridge block, buck converter block, SEPIC converter block, buck boost converter block, forward converter block or fly back converter block; and the processing blocks (2) have controllable switches and/or gates that are controlled by the chips (1).

12. A chip (1) for use in an operating device for lighting means, wherein the chip (1) is configured to control at least one processing block (2) in the operating device for lighting means, and wherein the chip (1) is adapted to control a plurality of different processing blocks (2) which differ in function, and the chip (1) is configured to select on the basis of at least one signal applied to the chip (1) what type of processing block (2) should be controlled; wherein the chip has a pin (3), and the pin (3) is used in a programming mode during the production of the operating device for the receipt of a selection signal and is used in normal operation to receive and/or output other signals.

13. The chip according to claim 12, wherein at least one processing block is selected from a performance correction filter (PFC) block, a half-bridge block, a buck converter block, a SEPIC converter block, a buck boost converter block, a forward converter block, or a fly back converter block.

14. The chip according to claim 13 wherein the chip (1) is configured to output control signals to control the processing block; and the control of the processing block (2) is based on an input signal applied to the chip (1).

15. The chip according to claim 14 wherein the selection of what type of processing block (2) should be controlled is based on the input signal; and the input signal has different parameters and the selection is based on at least one parameter chosen from the curve form, the frequency, the amplitude, the duty cycles, the threshold values, timings and max values of the input signal.

16. The chip according to claim 12 wherein the selection of which type of processing block (2) should be controlled is based on a selection signal applied to the chip (1); and the selection is based on the voltage level of the selection signal.

17. The chip according to claim 12, wherein controllable switches and/or gates (7) are disposed between the control units (6) and the pins (4, 5) in the chip (1); the chip (1) is configured such that the controllable switches and/or gates (7) are controlled by the signal applied to the chip (1) to select what type of processing block (2) should be controlled; and comparators (8) are included in the chip (1), which can control the controllable switches and/or gates (7) depending on the signal applied to the chip (1) to select what type of processing block (2) should be controlled.

18. The chip according to claim 17, wherein the controllable switches and/ or gates comprise FET transistors (7).

19. The chip according to claim 17, wherein the controllable switches and/or gates comprise one or several multiplexers.

20. An operating device for LED lighting means wherein the operating device is provided with at least one processing block (2) and at least one chip (1) assigned to the processing block (2) in accordance with claim 12.

21. The operating device for lighting means according to claim 20, wherein the operating device has several processing blocks (2) that comprise a different function each, wherein a chip (1) is assigned to each processing block; the processing blocks (2) of the operating device comprise a performance factor correction filter (PFC) block, half-bridge block, buck converter block, SEPIC converter block, buck boost converter block, forward converter block or fly back converter block; and the processing blocks (2) have controllable switches and/or gates that are controlled by the chips (1).

* * * * *